United States Patent [19]

Jahr

[11] Patent Number: 4,473,049

[45] Date of Patent: Sep. 25, 1984

[54] THROTTLE MODULATION MECHANISM

[75] Inventor: Wolfgang J. Jahr, Union Lake, Mich.

[73] Assignee: Eaton Corporation, Cleveland, Ohio

[21] Appl. No.: 453,542

[22] Filed: Dec. 27, 1982

[51] Int. Cl.[3] ..... F02D 9/00

[52] U.S. Cl. ..... 123/396; 74/858

[58] Field of Search ..... 123/342, 360, 376, 396, 123/400, 401; 74/857–860, 865, 867, 869; 192/0.09, 0.092

[56] References Cited

U.S. PATENT DOCUMENTS

| | | | |
|---|---|---|---|
| 2,533,180 | 12/1950 | Rhodes | 123/376 |
| 2,580,107 | 12/1951 | Long | 192/0.07 |
| 2,587,892 | 3/1952 | Price | 192/0.073 |
| 2,601,628 | 6/1952 | Price | 74/854 |
| 2,605,874 | 8/1952 | Price | 192/0.092 |
| 3,814,224 | 6/1974 | Podssuweit et al. | 74/858 |
| 4,210,110 | 7/1980 | Krebaum et al. | 261/DIG. 18 |
| 4,226,141 | 10/1980 | Espenschied | 74/858 |

FOREIGN PATENT DOCUMENTS

| | | | |
|---|---|---|---|
| 108131 | 8/1979 | Japan | 123/396 |

*Primary Examiner*—William A. Cuchlinski, Jr.
*Attorney, Agent, or Firm*—P. S. Rulon; C. H. Grace

[57] ABSTRACT

Disposed is a throttle modulation mechanism (10) disposed between a throttle pedal (28) and a fuel control device (12) for an unshown engine. Mechanism (10) is operable during shifting modes of an unshown transmission driven by the engine to dip and boost fuel delivery to the engine for synchronizing the transmission and/or reducing shifting shocks. Mechanism (10), which is controlled by a transmission logic (14), includes first and second levers (16, 20) interconnected for slaved movement by a torsion spring and fluid actuated cylinders (38, 40) which respectively dip and boost the throttle in response to logic signals applied to solenoid valves (50, 64).

8 Claims, 5 Drawing Figures

THROTTLE MODULATION MECHANISM

CROSS-REFERENCE TO RELATED APPLICATIONS

This application is related to U.S. applications 453,541, 453,544, and 453,668, all filed on Dec. 27, 1982 and all assigned to the assignee of this application.

BACKGROUND OF THE INVENTION

1. Field of the Invention

The present invention relates to a mechanism for automatically modulating fuel delivery to an engine. More specifically, the present invention relates to such a mechanism for synchronizing and/or reducing shifting shocks of a transmission.

2. Description of the Prior Art

It has been previously proposed to automatically modulate or vary the speed of an engine during shifting modes of a transmission in an effort to simulate what is done by an experienced driver during manual shifting. For example, U.S. Pat. No. 3,736,806 proposes increasing fuel delivery to an engine during manual shifting of a mechanical transmission; U.S. Pat. No. 3,834,499 proposes both increasing and decreasing fuel delivery to an engine during automatic shifting of a mechanical transmission; and U.S. Pat. No. 4,226,141 proposes decreasing fuel delivery to an engine during automatic shifting of a transmission to facilitate synchronization of the transmission and to reduce shifting shocks.

The prior art mechanisms for modulating engine speed during shifting modes of a transmission have had several disadvantages. Most have been on/off type mechanisms which have not provided smooth, precise change in engine speed and torque and, therefore, have provided less than optimum synchronizing and shift shock results. Some have been incorporated directly into fuel control devices and therefore have required complex and costly redesign of the fuel control devices. Some have operated directly on throttle pedal linkages with resulting mechanical feedback or physical movement of the throttle pedal. This feedback or movement, which is noticed by the operator, is disagreeable and interferes with proper and effective control of the vehicle.

Further, with respect to optimum synchronizing and shift shock, the prior art mechanisms have not readily provided the many different precise degrees of fuel delivery change necessary during shifting modes of a transmission. For example, precisely regulated, ramped, incremental increases and decreases of fuel delivery can greatly reduce shifting shocks felt by a vehicle operator, reduce torsional oscillations in the vehicle drivetrain, reduce synchronizing time, reduce energy consumed by synchronizing devices, and reduce impulse forces on jaw clutches.

SUMMARY OF THE INVENTION

An object of this invention is to provide a mechanism for controlling fuel delivery to a prime mover independent of throttle pedal position during shifting of a transmission driven by the prime mover.

Another object of this invention is to provide such a mechanism for controlling shifting shocks.

Another object of this invention is to provide such a mechanism for effecting synchronism in an automatic mechanical transmission.

According to a feature of the invention, the mechanism of the present invention is adapted to be interposed between an engine throttle pedal and an engine fuel control device such as throttle valve or a fuel injection device. The mechanism comprises first and second members mounted for relative movement and respectively adapted for slaved movement with the throttle pedal and the fuel control device; resilient means interconnecting the members for inphase movement in response to throttle pedal movement during nonshifting modes of the transmission; and means for moving the second member independent of the throttle pedal position during shifting modes of the transmission.

According to another feature of the invention, the mechanism, as adapted in the previous feature, includes first and second members mounted for relative pivotal movement about a common axis and respectively adapted for slaved movement with the throttle pedal and the fuel control device; a torsion spring interconnecting the members for inphase movement in response to throttle pedal movement during nonshifting modes of the transmission; and means for rotating the second member independent of the throttle pedal position during shifting modes of the transmission.

BRIEF DESCRIPTION OF THE DRAWINGS

The throttle modulation mechanism of the present invention is shown in the accompanying drawings in which.

Certain terminology referring to proposed environment, direction, and motion will be used in the following description. This terminology is for convenience and clarity in describing the invention and should not be considered limiting in the appended claims unless the claims are explicitly so limited.

DETAILED DESCRIPTION OF THE DRAWINGS

Figure 1:
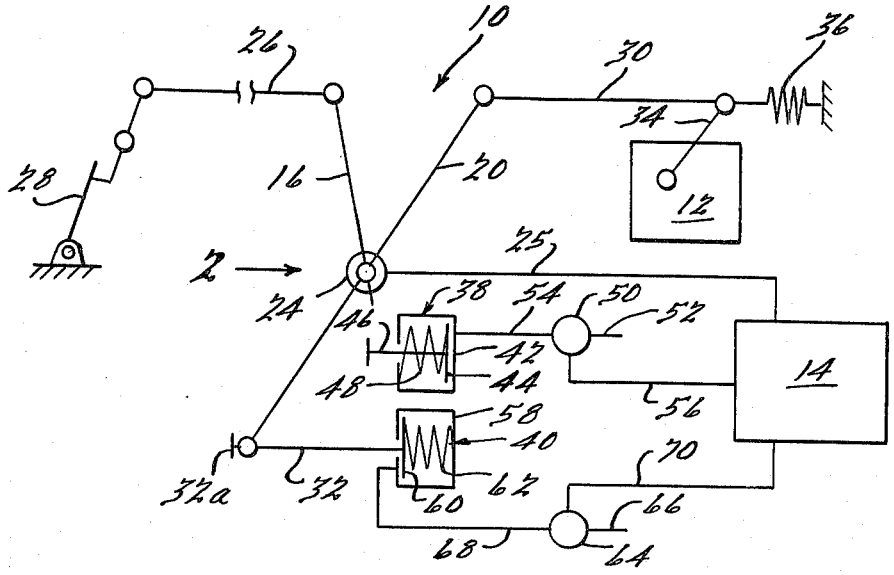
FIG. 1 schematically illustrates the modulation mechanism connected between a throttle pedal and a fuel control device with the mechanism in the idle throttle position.

FIG. 1 schematically shows a two-lever throttle modulation mechanism 10 for automatically decreasing and increasing fuel delivery from a fuel control mechanism 12 to an unshown prime mover in response to signals from a transmission logic 14 during shifting modes of an unshown transmission driven by the prime mover. Mechanism 10 is contemplated for use in a wheeled vehicle such as a truck. The prime mover may be of any adaptable type, e.g. the prime mover may be an engine of the Otto or diesel cycle type. The transmission may also be of any multiple ratio type, e.g., a manually shifted transmission employing positive or jaw-type clutches to effect ratio changes, an automatically shifted transmission employing friction clutches to effect ratio changes, or an automatically shifted transmission employing positive clutches to effect ratio changes. Mechanism 10 is contemplated for use with this latter type of transmission, which is often referred to as an automatic mechanical transmission. Such a transmission and logic system for controlling shifting is disclosed in U.S. Pat.

No. 4,361,060 which issued Nov. 30, 1982. U.S. Pat. No. 4,361,060 is incorporated herein by reference.

Figure 2:
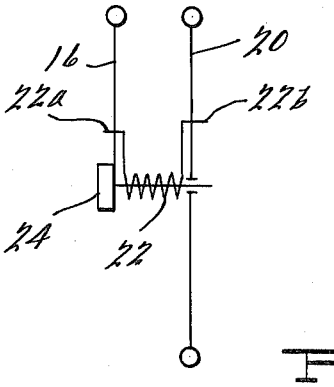
FIG. 2 is a side elevational view of the mechanism looking in the direction of arrow 2.

Looking now at FIGS. 1 and 2, mechanism 10 includes a first lever or member 16 fixed at one end to a shaft 18 mounted for rotation or oscillatory movement about its longitudinal axis, a second lever or member 20 mounted for rotational or oscillatory movement about the axis of shaft 18 and relative to the shaft and first lever 16, a torsion spring 22 coiled about shaft 18 and fixed at its opposite ends **22*a* and 22*b* to levers 16 and 20, and a potentiometer or pot 24 for providing an electrical signal representative of the position of first lever 16. The electrical signal is fed to logic 14 via a wire 25. First lever 16 is pivotally connected at its other end to a linkage mechanism 26 moved in direct response to the position of an operator-controlled throttle pedal 28. Hence pot 24 provides a signal representative of throttle pedal position. Second lever 20 is connected at its upper end to the left end of a link 30 by a pivot connection and at its lower end to a piston rod 32 by a slide-pivot connection. The right end of link 30 is pivotally connected to a lever 34 which varies fuel flow to the engine in response to rotation from the idle throttle position shown in FIG. 1 to the full or wide-open throttle position shown in FIG. 3. Second lever 20, link 30, and lever 34 are biased toward the idle throttle position by a spring 36**.

Figure 3:
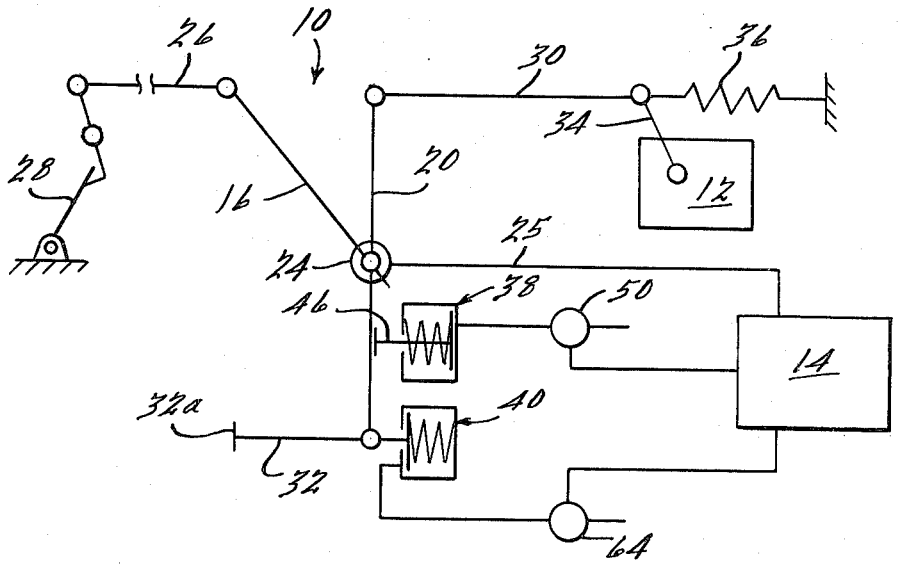
FIGS. 3–5 respectively illustrate the mechanism of FIG. 1 in a wide-open throttle position, a throttle dip position, and a throttle boost position.
Figure 4:
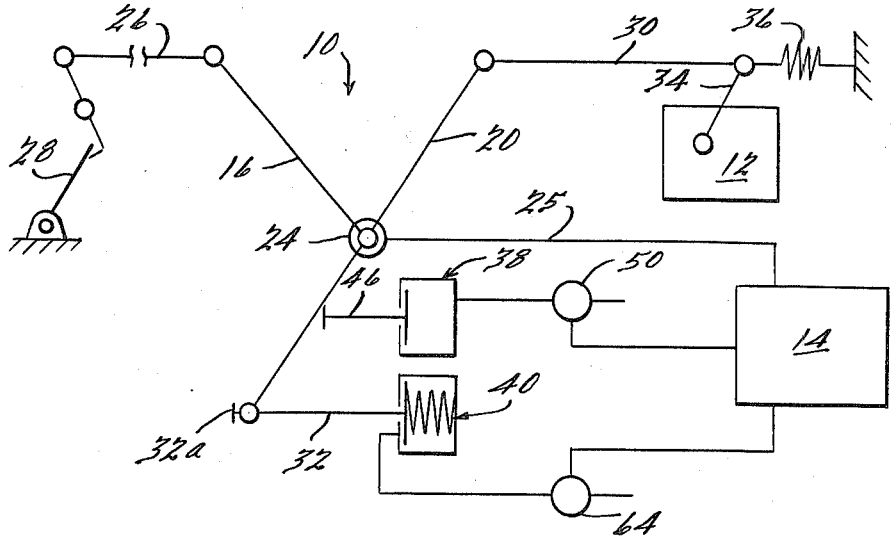

Mechanism 10 further includes a throttle dip cylinder 38 to rotate second lever 20 clockwise independent of first lever 16 and a throttle boost cylinder 40 to rotate second lever 20 counterclockwise independent of first lever 16. Dip cylinder 38 includes a cylinder housing 42, a piston 44, a piston rod 46 fixed to the piston, and a spring 48 biasing the piston to the right, as seen in FIGS. 1 and 3. Piston 44 is moved to the left by pressurized fluid controlled by an electrically operated valve 50. Valve 50 is connected to an unshown source of pressurized fluid, such as air, by a conduit 52 and to cylinder 38 by a conduit 54. Valve 50 is electrically connected to logic 14 via a wire 56. Boost cylinder 40 includes a cylinder housing 58, a piston 60, the piston rod 32 fixed to the piston, and a spring 62 biasing the piston to the left as seen in FIGS. 1, 3, and 4. An enlarged portion or stop **32*a* at the left end of rod 32 limits sliding movement of lever 20. A valve 64, substantially identical to valve 50, is connected to the source of pressurized fluid by a conduit 66 and to cylinder 40 via a conduit 68. Valve 64 is electrically connected to logic 14 via a wire 70**.

Figure 5:
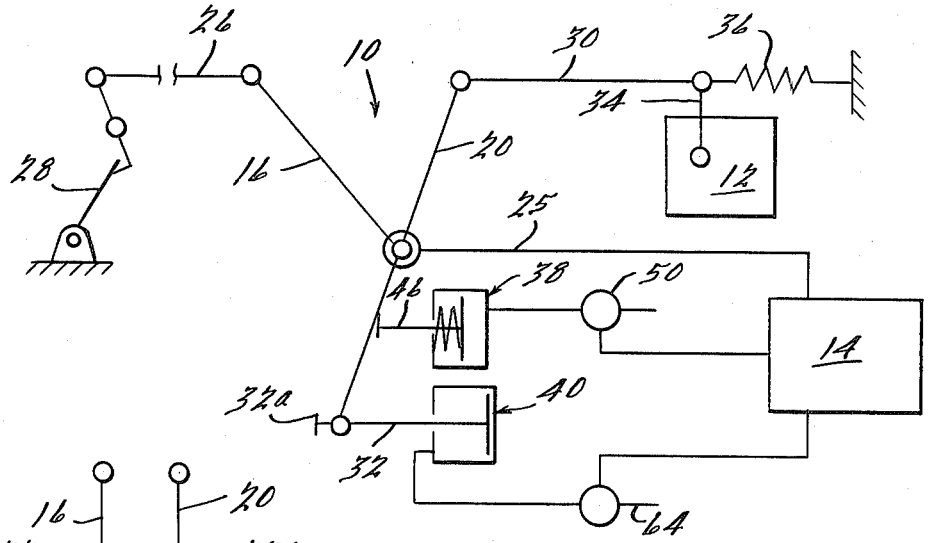

During nonshifting modes of the transmission, the pistons of the dip and boost cylinders remain in the positions shown in FIGS. 1 and 3, whereby complete control of fuel delivery to the engine is a function of throttle pedal position due to the torsion spring interconnection of first and second levers 16 and 20. In FIG. 1, throttle pedal 28 and fuel control lever 34 are in the idle position. In FIG. 3, the throttle pedal and fuel control lever 34 are in the wide-open or "full" throttle position. During shifting modes of the transmission, as shown in FIGS. 4 and 5, logic 14 energizes valves 50 and 64 in predetermined sequences to change the position of the fuel control lever 34 without actual movement of the throttle pedal due to the spring connection between first and second levers 16, 20.

Valves 50, 64 may be of the nonpressure regulating type which either vent or apply full fluid pressure to the cylinder in response to the presence or absence of electrical signals from logic 14, whereby the cylinder pistons are either fully actuated or unactuated. Valves 50 and 64 are preferably of the pressure regulating type which control the pressure of the fluid to an from the cylinders, thereby controlling the piston position and rate of movement. Further, valves 50 and 64 may each be replaced by two or more valves controlled by the logic. Such valves and logics for controlling them are well-known, e.g., the valves may be responsive to amplitude modulated or duty cycle modulated signals from the logic. One valve could be energized to vent its associated cylinder and the other to port fluid pressure to its associated cylinder.

Operation

To describe operation, it will be assumed that mechanism 10 is in a wheeled vehicle in combination with an automatic mechanical transmission having jaw-type clutches for engaging and disengaging step ratio gears in the transmission and friction type master clutch interposed between the prime mover and the transmission. The jaw and master clutches are controlled by logic 14. Further, logic 14 maintains the master clutch disengaged when the vehicle is at rest and an unshown switch indicates that throttle pedal is in the idle position. The unshown switch may be incorporated in pot 24 in a well-known manner with an electrical signal therefrom supplied to logic 14 by wire 25. The transmission may further include devices to assist synchronization of the jaw clutches, e.g., the jaw clutches may each include a synchronizer which effects upshift and downshift synchronization or retarder and accelerator devices which respectively effect upshift and downshift synchronizing of all of the ratios. The retarder may be a brake connected to the transmission input shaft, and the accelerator may be a clutch operative to connect the input shaft with a faster rotating member. Such retarder and accelerator devices are well-known in the art and are readily made responsive to signals from a logic. Further, size, wear, and effectiveness of all of these devices is enhanced by mechanism 10 since the amount of torque they would often have be handled is decreased by throttle modulation.

Assuming now that the transmission shift selector is in a forward drive position with the throttle pedal in the idle position and the vehicle at rest, the master clutch is therefor disengaged, and a starting ratio gear is engaged. When the throttle pedal is depressed, the master clutch is engaged at a rate determined by throttle pedal position and other known parameters. When the vehicle reaches a speed determined by throttle position and other parameters, logic 14 initiates an upshift mode; at this time the throttle pedal may be at any position between idle as shown in FIG. 1 and wide-open throttle as shown in FIG. 3. The upshift mode may comprise several different sequences to effect the upshift. Herein is one sequence: logic 14 sends a throttle dip signal to valve 50 via wire 56 to dip the throttle or decrease fuel delivery to the engine, thereby reducing engine torque in the vehicle drivetrain and suspension system at a controlled rate prior to disengagement of the master clutch. Concurrent or substantially concurrent with the throttle dip signal, logic 14 initiates disengagement of the then-engaged jaw clutch, which will not normally move to the disengaged position until the driveline torque across the jaws diminishes. The logic then initiates disengagement of the master clutch, if the transmission includes a retarder, such as a brake, to reduce input shaft speed for synchronizing the jaw clutch to be engaged for the next upshift ratio. As synchronization is reached, the logic initiates engagement of the jaw clutch and then reengagement of the master clutch at a controlled rate, and then throttle controlling the boost by merely venting dip actuator 38 or by venting dip actuator 38 and pressurizing boost actuator 40, to control the rate of engine speed and torque rise commensurate with a smooth shift. Further upshifts are substantially the same.

Downshifts differ principally in that they require an increase in input shaft speed to effect synchronization. When logic 14 senses the need for a downshift, a throttle dip signal is sent to valve 50 via wire 56 as during an upshift. Concurrent or substantially concurrent with the throttle dip signal, logic 14 initiates disengagement of the then-engaged jaw clutch which will not normally move to disengaged position until the driveline torque across the jaws diminishes. The logic then initiates disengagement of the master clutch. If the transmission includes an accelerator device, as previously mentioned, the device increases the input shaft speed to synchronize the jaw clutch to be engaged while the master clutch remains disengaged; as synchronization is reached, the logic initiates engagement of the jaw clutch and then engagement of the master clutch. If the transmission does not include such a device, logic 14 initates engagement of the master clutch and then throttle boost to effect synchronization by sending a boost signal to valve 64, then disengagement of the master clutch as synchronization is reached and engagement of the jaw clutch, and then reengagement of the master clutch at a controlled rate. This engagement, disengagement, and reengagement of the master clutch during the downshift sequence is the well-known double clutch procedure long practiced by operators of manually shifted transmissions.

One embodiment of the invention has been disclosed for illustrative purposes. Many variations and modifications of the disclosed embodiment are believed to be within the spirit of the invention. To mention but a few of such variations, torsion spring 22 could be replaced by some other type of resilient device, or spring 22 could be torsionally preloaded so as to bias second lever 20 counterclockwise into a stop defined by first lever 16. This preloading-and-stop modification allows reduction of the spring rate of the torsion spring and simplifies rigging of the throttle linkage system. However, it also causes a physical feedback or movement of the throttle pedal during some throttle dip operations of the modulation mechanism. The following claims are intended to cover the inventive portions of the invention and variations and modifications within the spirit of the disclosed invention.

What is claimed is:

1. A mechanism adapted to be interposed between an engine throttle pedal and an engine fuel control device for varying fuel delivery to an engine during shifting modes of a transmission driven by the engine, the mechanism comprising:

a first member mounted for pivotal movement about an axis and adapted for slaved movement with the throttle pedal;

a second member mounted for pivotal movement relative to said first member about said axis and adapted to be connected with the fuel control device for slaved movement therewith;

means interconnecting said members to normally effect inphase movement of said members in response to movement of the first member; and actuator means including fluid pressure responsive means operative to move said second member to-and-fro about said axis independent of the position of the first member for respectively decreasing and increasing the fuel flow, said actuator means comprising a first fluid pressure responsive means operative to pivotally move said second member in one direction about said axis for decreasing the fuel flow and a second fluid pressure responsive means operative to pivotally move said second member in the other direction about said axis for increasing the fuel flow.

2. The mechanism of claim 1, wherein said means interconnecting comprises a resilient means.

3. The mechanism of claim 2, further including transducer means for producing a signal representative of the pivotal position of said first member and independent of the pivotal position of said second member effected by said actuator means.

4. The mechanism of claim 3, wherein said means interconnecting comprises a torsion spring allowing full range pivotal movement of said second member by said actuator means with substantially no movement of said first member independent of the pivotal position of said first member.

5. In a vehicle having ground engaging wheels driven by a multiple, step ratio transmission connected to a combustion engine; an operator controlled throttle pedal for varying fuel delivery to the engine by a fuel control device; and an improved mechanism for varying the fuel delivery independent of the throttle pedal position during shifting modes of the transmission; the improved mechanism comprising:

a first member slaved for pivotal movement about an axis in response to movement of the throttle pedal;

a second member mounted for pivotal movement relative to said first member about said axis and connected with the fuel control device for slaved movement therewith;

means interconnecting said members to normally effect inphase movement of said members in response to movement of said first member; and actuator means including fluid pressure responsive means operative to pivotally move said second member to-and-fro about said axis independent of the position of the first member for respectively decreasing and increasing the fuel flow, said actuator means comprising a first fluid pressure responsive means operative to pivotally move said second member in one direction about said axis for decreasing the fuel flow and a second fluid pressure responsive means operative to pivotally move said second member in the other direction about said axis for increasing the fuel flow.

6. The mechanism of claim 5, wherein said means interconnecting comprises a resilient means.

7. The mechanism of claim 6, further including transducer means for producing a signal representative of the pivotal position of said first member and independent of the pivotal position of said second member effected by said actuator means.

8. The mechanism of claim 7, wherein said means interconnecting comprises a torsion spring allowing full-range pivotal movement of said second member by said actuator means with substantially no movement of said first member independent of the pivotal position of said first member.

* * * * *